US011181850B2

(12) United States Patent
Chen et al.

(10) Patent No.: US 11,181,850 B2
(45) Date of Patent: Nov. 23, 2021

(54) POWDER DISCHARGING STRUCTURE AND POWDER CYLINDER

(71) Applicant: TANGSHAN CAOFEIDIAN IMAGING TECHNOLOGY LTD. CO., Hebei (CN)

(72) Inventors: Bo Chen, Hebei (CN); Hongbin Wang, Hebei (CN)

(73) Assignee: TANGSHAN CAOFEIDIAN IMAGING TECHNOLOGY LTD. CO., Hebei (CN)

( * ) Notice: Subject to any disclaimer, the term of this patent is extended or adjusted under 35 U.S.C. 154(b) by 0 days.

(21) Appl. No.: 16/966,881

(22) PCT Filed: Jan. 31, 2019

(86) PCT No.: PCT/CN2019/074121
§ 371 (c)(1),
(2) Date: Jul. 31, 2020

(87) PCT Pub. No.: WO2019/154253
PCT Pub. Date: Aug. 15, 2019

(65) Prior Publication Data

US 2021/0055673 A1 Feb. 25, 2021

(30) Foreign Application Priority Data

Feb. 6, 2018 (CN) ..... 201810115704.1

(51) Int. Cl.
*G03G 15/08* (2006.01)

(52) U.S. Cl.
CPC ..... *G03G 15/0877* (2013.01); *G03G 15/0872* (2013.01)

(58) Field of Classification Search
CPC ..... G03G 15/0877; G03G 15/0872
See application file for complete search history.

(56) References Cited

U.S. PATENT DOCUMENTS 5,017,966 A * 5/1991 Suga ..... G03G 15/0877 222/DIG. 1
2018/0143565 A1* 5/2018 Chuang ..... G03G 15/0872

* cited by examiner

*Primary Examiner* — Sandra Brase

(57) ABSTRACT

A toner outlet structure includes: an outlet front cover communicating with a toner bottle containing toner, wherein the outlet front cover has a toner outlet; a toner lever rotatably arranged in the outlet front cover, wherein a plurality of blades are provided on the toner lever; and a toner outlet elastic sheet having a fixed end and a free end opposite to the fixed end, wherein the fixed end is fixed in the outlet front cover; the toner outlet elastic sheet extends in a circumferential direction of the toner lever, and extends into a circular track formed by rotation of the blades; wherein the blades rotate together with the toner lever to scrape the toner sent from the toner bottle to one side of the toner outlet elastic sheet; as the blades rotate, the blades contact and press the toner outlet elastic sheet.

12 Claims, 14 Drawing Sheets

POWDER DISCHARGING STRUCTURE AND POWDER CYLINDER

BACKGROUND OF THE PRESENT INVENTION

Field of Invention

The present invention relates to a technical field of printer and copier accessories, and more particularly to a toner outlet structure and a toner cartridge.

Description of Related Arts

In developing devices such as printers, copiers, or fax machines, the toner contained in the toner cartridge needs to be ejected for printing through a toner outlet structure. Conventional toner outlet structure of the toner cartridge usually uses an air blower mechanism such as an airbag, wherein air is blown into and out of the deformable airbag to increase an internal pressure, thereby blowing out the toner.

Chinese patent application CN 201710384730.X disclosed a toner outlet device and a toner cartridge using the same. The toner outlet device comprises a toner outlet hose, a peristaltic support and a peristaltic sleeve, wherein the toner outlet hose is bent into an arc shape, one end of which is a toner inlet and the other end is a toner outlet; a center of the peristaltic sleeve is provided with a peristaltic mandrel which is installed on the peristaltic support; the peristaltic mandrel rotates relative to the peristaltic sleeve and/or the peristaltic support; the peristaltic support is installed inside the arc shape of the toner outlet hose so that the peristaltic sleeve contacts and presses the toner outlet hose; the toner outlet hose is fixed; the peristaltic support rotates relative to the toner outlet hose, and squeezes the toner in the toner outlet hose from the toner inlet to the toner outlet.

Compared with the conventional compressed airbag toner outlet method where the toner cannot be ejected continuously, the above technical solution can continuously eject the toner, but has the following shortcomings:

First, the toner needs to be fed and stored in a receiving bin before being outputted through the toner outlet hose. The toner outlet hose is a limited toner storage space which is soft and closed. The toner transfer space is narrow and the toner is easy to agglomerate. When the developing device is idle, the toner in the toner outlet hose will adsorb each other and deposit and harden into toner lumps, which will affect the next toner ejection.

Second, the toner cartridge squeezes out the toner through contacting and pressing two sealing points by the peristaltic sleeve. The toner cartridge only supplies toner twice after one revolution, so the toner outlet speed is not enough.

Third, the toner outlet hose, peristaltic sleeve, the peristaltic mandrel, and peristaltic support used in the toner outlet device are difficult to install, and time-consuming and laborious to operate, which affect production efficiency.

SUMMARY OF THE PRESENT INVENTION

A main object of the present invention is to provide a toner outlet structure, so as to solve problems that toner in the conventional toner outlet device is easy to deposit and agglomerate, toner outlet speed is slow, and structure assembly is inconvenient.

In order to accomplish the above object, the present invention provides a toner outlet structure, comprising:

an outlet front cover communicating with a toner bottle containing toner, wherein the outlet front cover has a toner outlet;

a toner lever rotatably arranged in the outlet front cover, wherein a plurality of blades are provided on the toner lever; and a toner outlet elastic sheet having a fixed end and a free end opposite to the fixed end, wherein the fixed end is fixed in the outlet front cover; the toner outlet elastic sheet extends in a circumferential direction of the toner lever, and extends into a circular track formed by rotation of the blades;

wherein the blades rotate together with the toner lever to scrape the toner sent from the toner bottle to one side of the toner outlet elastic sheet; as the blades rotate, the blades contact and press the toner outlet elastic sheet, in such a manner that the free end of the toner outlet elastic sheet is deformed along a centrifugal direction of edges of the blades; when the blades rotate to separate from the toner outlet elastic sheet, the free end of the toner outlet elastic sheet rebounds with an elastic force thereof, thereby slapping out the toner from the toner outlet.

The above toner outlet structure is used to send the toner out of the toner bottle. First, the blades on the toner lever scrapes the toner entering the outlet front cover to the side of the toner outlet elastic sheet along a rotation direction of the blades. When one of the blades contacts the toner outlet elastic sheet, the blade presses against the free end of the toner outlet elastic sheet to bend it. While the blade applies an elastic force on the toner outlet elastic sheet, a next blade continuously scrapes the toner to the toner outlet elastic sheet until the previous blade rotates to separate from the toner outlet elastic sheet. The toner outlet elastic sheet rebounds under the elastic force, so that the toner outlet elastic sheet beats and squeezes the toner nearby, thereby ejecting the toner in the outlet front cover. Then the next blade rotates to contact the toner outlet elastic sheet, leading to repeated elastic deformation and rebounding of the toner outlet elastic sheet. Repeating such cycle can achieve a fixed rhythm of toner ejection. Therefore, the toner lever has multiple blades. After one revolution of the toner lever, the toner outlet structure can realize the same number of toner ejection as the number of blades, which effectively increase a toner outlet speed. In addition, while the toner output speed is increased, flow performance of the toner in the outlet front cover is correspondingly increased, which reduces toner accumulation in the toner output structure, thereby further improve the toner output speed.

Preferably, the toner outlet structure further comprises:

a toner receiving box arranged in the outlet front cover, wherein a cavity is formed in the toner receiving box; one side of the toner receiving box has a side opening, and a bottom of the toner receiving box has a toner ejector;

wherein the toner lever is arranged on one side of the toner receiving box near the side opening, and the toner receiving box is embedded at the toner outlet; when the toner lever is driven to rotate, the blades scrapes the toner into the cavity of the toner receiving box through the side opening.

By placing the toner receiving box on a side of the toner outlet elastic sheet facing the toner outlet, the toner is concentratedly scraped into the toner receiving box when the blades rotate for collection. On the other hand, when the blades rebound, the toner will not spread to the side under the slap of the blades, but will be mainly ejected out from the toner ejector, thereby increasing the toner outlet speed.

Preferably, toner outlet elastic sheet is bent from the fixed end to form a bent part, and the bent part is attached and glued to the toner receiving box. Due to the adhesive fixing method, compared with the prior art, the toner outlet elastic sheet does not require high dimensional installation accuracy. The structure is simple, which saves time and effort during installation.

Preferably, a baffle is provided on the fixed end of the toner outlet elastic sheet, and the baffle is connected to an internal wall of an internal cover.

With the baffle, the toner outlet elastic sheet can be kept in a downwardly bent state when in a free state, ensuring a sufficient rebound force of the toner outlet elastic sheet for slapping the toner out.

Preferably, the blades are arranged at equal intervals around an axis of the toner lever, in such a manner that a middle arc of a cross section obtained by cutting the blades in a plane perpendicular to the axis of the toner lever is arc-shaped; the blades extend outwards from a circumference surface of the toner lever in an arc-shaped form; directions of internal arc surfaces of the blades are consistent with a rotation direction of the blades. The arc-shaped blades can scrape more toner.

Preferably, the toner outlet structure further comprises:

a toner stirring rack, wherein a driving gear is fixed at a front end of the toner stirring rack;

wherein a driven gear is fixed to a front end of the toner lever having the blades, and the driving gear is engaged with the driven gear; a transmission ratio of the driving gear to the driven gear is 1:N, and N>1.

The gears drive the toner stirring rack to rotate the toner lever, and the toner stirring rack rotates with the toner bottle. Through setting the transmission ratio, a rotation frequency of the toner lever relative to the toner bottle can be increased, which increases a rotation speed of the blades relative to the toner bottle. After one revolution of the toner bottle, the number of toner ejection of the toner output structure equals to the number of the blades divided by the transmission ratio thereby further increasing the toner output speed.

Preferably, the toner stirring rack comprises:

a toner stirrer, wherein the toner stirrer is parallel to the toner lever and is installed in the outlet front cover; and a toner stirring brush arranged at one end of the toner stirrer in the outlet front cover, and is parallel to the blades for stirring the toner in the outlet front cover.

Compared with the prior art, the toner stirring rack adopts the toner stirring brush to stir the toner in the outlet front cover. Therefore, while the blades scrape the toner out, it is ensured that the toner in other parts of the outlet front cover moves synchronically, thereby ensuring smooth movement of the toner in the toner output structure.

Preferably, the toner stirring rack further comprises:

a toner collecting sheet arranged on the other end of the toner stirrer away from the toner stirring brush, to receive the toner from the toner bottle; and multiple spiral sheets arranged between the toner collecting sheet on the toner stirrer and the toner stirring brush, wherein the spiral sheet spirally extends around the toner stirrer, and a toner channel is formed between adjacent spiral sheets.

In order to make the toner outlet elastic sheet more powerful to slap the toner, it is necessary to ensure that there is enough toner in the outlet front cover. The spiral sheets ensure that the toner collected by the toner collecting sheet is mainly guided to vicinity of the blades of the toner lever in the spiral direction, and then slapped out by the toner outlet elastic sheet.

Preferably, the toner lever comprises:

a first rod body, wherein a V-shaped hook is provided on a rear side of the first rod body; and a second rod body, wherein a connector cooperating with the V-shaped hook is formed at a front side of the second rod body; the blades are provided on the second rod body;

wherein the driven gear is integrally formed at a front end of the first rod body; the first rod body passes through a front end of the outlet front cover and is engaged with the second rod body.

By integrally forming the driven gear and the toner lever, installation is easier compared to gear mounting method using screws. Since the toner lever needs to be installed in the outlet front cover, the toner lever is separated into two sections. During installation, the second rod body is installed in the outlet front cover, and then the first rod body where the driven gear is located passes through the front end of the outlet front cover to be engaged with the second rod body. There is no need for screw connection, and the installation is convenient.

Preferably, a front side of the toner stirring rack has a waist-shaped connecting portion, a cylindrical portion, and a limiting round boss in sequence along an axial direction; the cylindrical portion passes through the front end of the outlet front cover and is rotatable; the waist-shaped connecting portion is arranged at a front side of the cylindrical portion, and penetrates out of the outlet front cover; the driving gear is fixed to the waist-shaped connecting portion; the limiting round boss protrudes on a rear side of the cylindrical portion; and a toner stirring rack sealing ring is arranged between the limiting round boss and the outlet front cover.

Another object of the present invention is to provide a toner cartridge, comprising:

a toner bottle containing toner; and a toner outlet structure, wherein the toner bottle is rotatably connected to a rear end of an outlet front cover.

With the foregoing structure, the toner in the toner bottle is ejected through the above toner outlet structure, which improves the toner outlet speed of the toner cartridge.

Preferably, the outlet front cover comprises:

an internal cover, wherein a toner outlet is provided at a bottom of the internal cover; and a toner bottle connecting part is provided at a rear end of the internal cover, which is rotatably connected to the toner bottle;

an internal front cover fixed to a front end of the internal cover; and a toner outlet holder installed at a bottom of the internal cover for opening or closing the toner outlet.

Preferably, the toner outlet holder has two opposing toner outlet holder bayonets at two sides along a front-rear direction; two internal cover fixing blocks corresponding to the toner outlet holder bayonets are provided at two sides of the internal cover along the front-rear direction, which are used to clamp and fix the toner outlet holder and the internal cover; the outlet front cover further comprises: an external cover, wherein two rear cover fixing blocks are provided at a rear side of the external cover; two elastic buckles cooperating with the rear cover fixing blocks are provided at two sides of the toner outlet holder along the front-rear direction, which are used to fix the external cover and the toner outlet holder; wherein the external cover is also provided with a guide groove extending from front to rear; the internal cover is provided with a guide plate cooperating with the guide groove; all parts of the internal cover are arranged in the external cover except the toner bottle connecting part.

Preferably, a bottom of a toner receiving box is embedded at the toner outlet of the internal cover, and a toner receiving box sealing gasket is provided at the toner outlet; the toner receiving box sealing gasket has a first sealing gasket through hole; the toner outlet holder has a toner outlet holder through hole, and a toner outlet holder sealing gasket is provided at the toner outlet holder through hole; the toner outlet holder sealing gasket has a second gasket through hole; a toner ejector of the toner receiving box is connected to the first sealing gasket through hole, the second sealing gasket through hole, and the toner outlet holder through hole in sequence; a toner outlet sliding plate is provided in the toner outlet holder, which moves back and forth relative to the toner outlet holder; the toner outlet sliding plate has a sliding plate through hole; when the sliding plate through hole corresponds to the toner outlet holder through hole, the toner is slapped out through the sliding plate through hole.

Preferably, the toner bottle comprises:

a toner bottle main body, wherein a spiral groove is formed on a circumference surface of the toner bottle main body;

a toner adding tube formed at a rear end of the toner bottle main body, wherein an anti-retraction ring is fastened on the toner adding tube, and the anti-retraction ring has an external thread;

a bottle bottom cover threadedly connected to the toner adding tube for sealing the toner adding tube;

a bottle bottom sealing gasket arranged in the bottle bottom cover; and a toner outlet tube formed at a front end of the toner bottle main body.

Preferably, a main gear is fixed on a side of the toner outlet tube near the toner bottle main body for driving the toner bottle main body to rotate.

Preferably, an annular rib protrudes and is formed on an external circumference of the toner outlet tube; the toner bottle connecting part is provided at the rear end of the internal cover, and the toner bottle connecting part is cylindrical; a toner bottle front sealing ring is provided at an internal end of the toner bottle connecting part; a plurality of elastic hooks are arranged on a rear side of the toner bottle connecting part, and the elastic hooks are hung on the annular rib, in such a manner that the toner bottle connecting part is rotatable relative to the toner bottle.

Preferably, a toner stirring rack positioning sheet is provided on an external circumference of the toner stirring rack; a positioning groove is provided at a front side of an internal circumference of the toner bottle; an opening of the positioning groove faces forward; the toner stirring rack positioning sheet is inserted into the positioning groove from front to rear; a limiting boss is provided at a front side of the toner stirring rack along an axial direction thereof; a front end of the toner stirring rack is installed on the internal cover and is limited by the limiting boss.

Compared with the prior art, beneficial effects of the present invention are as follows:

1. The present invention provides a novel toner outlet structure, which combines the toner lever and the toner outlet elastic sheet. The rotation of the multiple blades on the toner lever scrapes the toner outlet elastic sheet to generate elastic deformation, while the toner is scraped to the side of the toner outlet elastic sheet. The toner outlet elastic sheet bounces when the blades alternates to slap the toner out. As a result, after one revolution of the toner lever, the toner outlet elastic sheet can beat the toner out many times. Compared with the conventional toner outlet method using airbag extrusion, the present invention greatly improves the toner outlet speed.

2. The toner outlet structure of the present invention adopts the toner receiving box at the toner outlet of the outlet front cover, to receive the toner scraped by the blades, which also ensures that when the toner on the side of the toner outlet elastic sheet is slapped, the toner can be ejected from the toner ejector at the bottom of the toner receiving box, thereby ensuring sufficient toner output amount for each time.

3. The toner outlet structure of the present invention also adopts the toner stirring brush above the toner lever and the toner outlet elastic sheet. The toner stirring brush stirs and prevents the toner in the outlet front cover from being squeezed into blocks, which further ensures smooth movement of the toner in the outlet front cover. The toner stirring brush is placed on and rotates with the toner stirring rack, so no other power is needed.

4. In the present invention, the toner lever is driven to rotate by the toner stirring rack through gear transmission, and the toner outlet speed is further improved by setting a certain transmission ratio.

5. All components of the toner outlet structure provided by the present invention are simple in structure, wherein the toner outlet elastic sheet is glued and two ends of the toner lever and the toner stirring rack are connected by buckles. There are few installations that use screws to fix, Therefore, processing and operation are convenient, time and effort are saved in installation, and production efficiency is improved.

6. The present invention also provides the toner cartridge. Because the toner cartridge adopts the above toner outlet structure, it can improve the production efficiency and reduce the manufacturing cost while increasing the toner outlet speed.

BRIEF DESCRIPTION OF THE DRAWINGS

In order to explain embodiments of the present invention or technical solutions in the prior art more clearly, drawings used will be briefly introduced below. Obviously, the following drawings only describe some embodiments of the present invention. For those of ordinary skill in the art, without creative work, other drawings can be obtained based on the structures shown in these drawings.

ELEMENT REFERENCE

Figure 1:
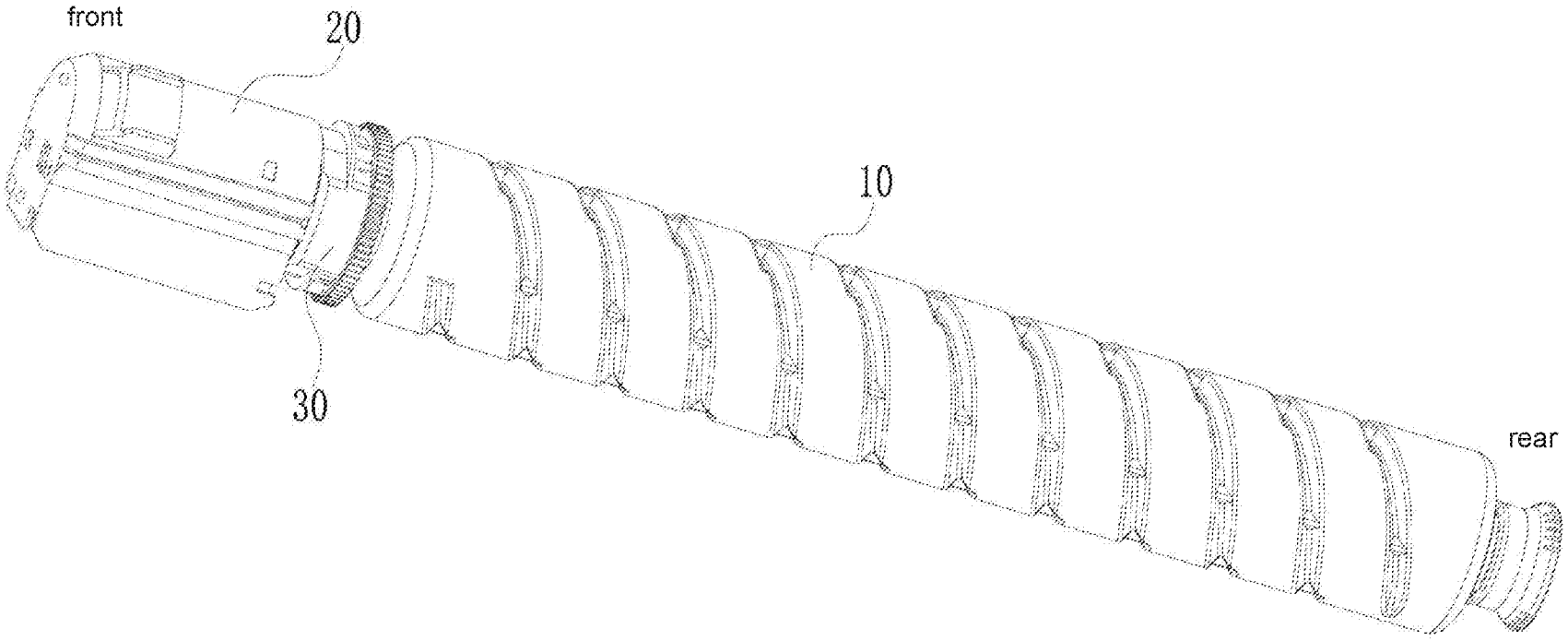
FIG. 1 is a perspective view of a toner cartridge according to an embodiment of the present invention.

| Number | Name |
|---|---|
| 10 | toner bottle |
| 20 | toner outlet structure |
| 30 | sensing ring |
| 100 | toner bottle main body |
| 200 | anti-retraction ring |
| 300 | bottle bottom cover |
| 310 | bottle bottom sealing gasket |
| 110 | toner adding tube |
| 120 | toner outlet tube |
| 121 | annular rib |
| 122 | positioning groove |
| 130 | main gear |
| 140 | spiral groove |
| 400 | outlet front cover |
| 410 | internal cover |
| 411 | toner outlet |
| 412 | toner bottle connecting part |
| 413 | internal cover fixing block |
| 415 | guide plate |
| 420 | internal front cover |
| 421 | welding rib |
| 430 | toner outlet holder |
| 431 | toner outlet holder bayonet |
| 432 | toner outlet sliding plate |
| 433 | elastic buckle |
| 434 | toner outlet holder sealing gasket |
| 440 | external cover |
| 441 | rear cover fixing block |
| 442 | guide groove |
| 450 | toner bottle front sealing ring |
| 460 | baffle |
| 500 | toner outlet elastic sheet |
| 510 | fixed end |
| 520 | bent part |
| 530 | free end |
| 600 | toner receiving box |
| 610 | toner ejector |
| 620 | toner receiving box sealing gasket |
| 630 | bottom plate |
| 631 | bottom convex portion |
| 640 | back plate |
| 650 | sideplate |
| 660 | side opening |
| 700 | toner lever |
| 710 | first rod body |
| 720 | second rod body |
| 730 | driven gear |
| 740 | toner lever sealing ring |
| 750 | blade |
| 800 | toner stirring rack |
| 810 | toner stirrer |
| 820 | toner collecting sheet |
| 830 | spiral sheet |
| 840 | toner stirring brush |
| 850 | toner stirring rack positioning sheet |
| 860 | limiting round boss |
| 861 | waist-shaped connecting portion |
| 862 | cylindrical portion |
| 870 | toner stirring rack sealing ring |
| 880 | toner channel |
| 890 | driving gear |

DETAILED DESCRIPTION OF THE PREFERRED EMBODIMENT

The technical solutions in the embodiments of the present invention will be clearly and completely described below in conjunction with the accompanying drawings. Obviously, the described embodiments are only a part of all embodiments of the present invention. Based on these embodiments, all other embodiments obtained by those of ordinary skill in the art without creative work shall fall within the protection scope of the present invention.

It should be noted that all directional indications (such as up, down, left, right, front, back . . . ) in the embodiments of the present invention are only used to explain the difference between components in a specific posture (as shown in the accompanying drawings). If the relative position relationship, movement situation, etc. change, the directional indication will change accordingly.

In addition, in the present invention, descriptions involving "first", "second", etc. are only for descriptive purposes, and cannot be understood as indicating or implying their relative importance or implicitly indicating the number of indicated technical features. Therefore, the features defined with "first" and "second" may explicitly or implicitly include at least one of the features. In the description of the present invention, "a plurality of" means at least two, such as two, three, etc., unless otherwise specifically defined.

In the present invention, unless otherwise clearly specified and limited, the terms "connected", "fixed", etc. should be interpreted broadly. For example, "fixed" can be a fixed connection, a detachable connection, or integral; it can be a mechanical connection or an electrical connection; it can be a direct connection or an indirect connection through an intermediate medium; and it can be an internal communication between two components or an interaction relationship between two components, unless specifically defined otherwise. For those of ordinary skill in the art, the specific meanings of the above terms in the present invention can be understood according to specific circumstances.

In addition, the technical solutions between the various embodiments of the present invention can be combined with each other, but they must be based on what can be achieved by those of ordinary skill in the art. When the combination of technical solutions is contradictory or cannot be achieved, it should be considered as non-exist and not within the protection scope of the present invention.

Referring to FIG. 1, a perspective view of a toner cartridge according to an embodiment, the embodiment comprises a toner bottle 10, a toner outlet structure 20 connected to one end of the toner bottle 10, and a sensing ring 30. For ease of description, an end where the toner outlet structure 20 of a toner cartridge is located is defined as a front end, and an end where the toner bottle 10 of the toner cartridge is located is defined as a rear end.

The toner cartridge is installed in a printing equipment such as a printer and a copier. The toner bottle 10 contains toner (carbon toner), which is driven to rotate by a driving device in the printing device, and supplies a developing device in the printing device with the toner through the toner outlet structure 20. The sensor ring 30 is connected to a control device of the printing device for controlling a rotation speed of the toner bottle 10.

Figure 2:
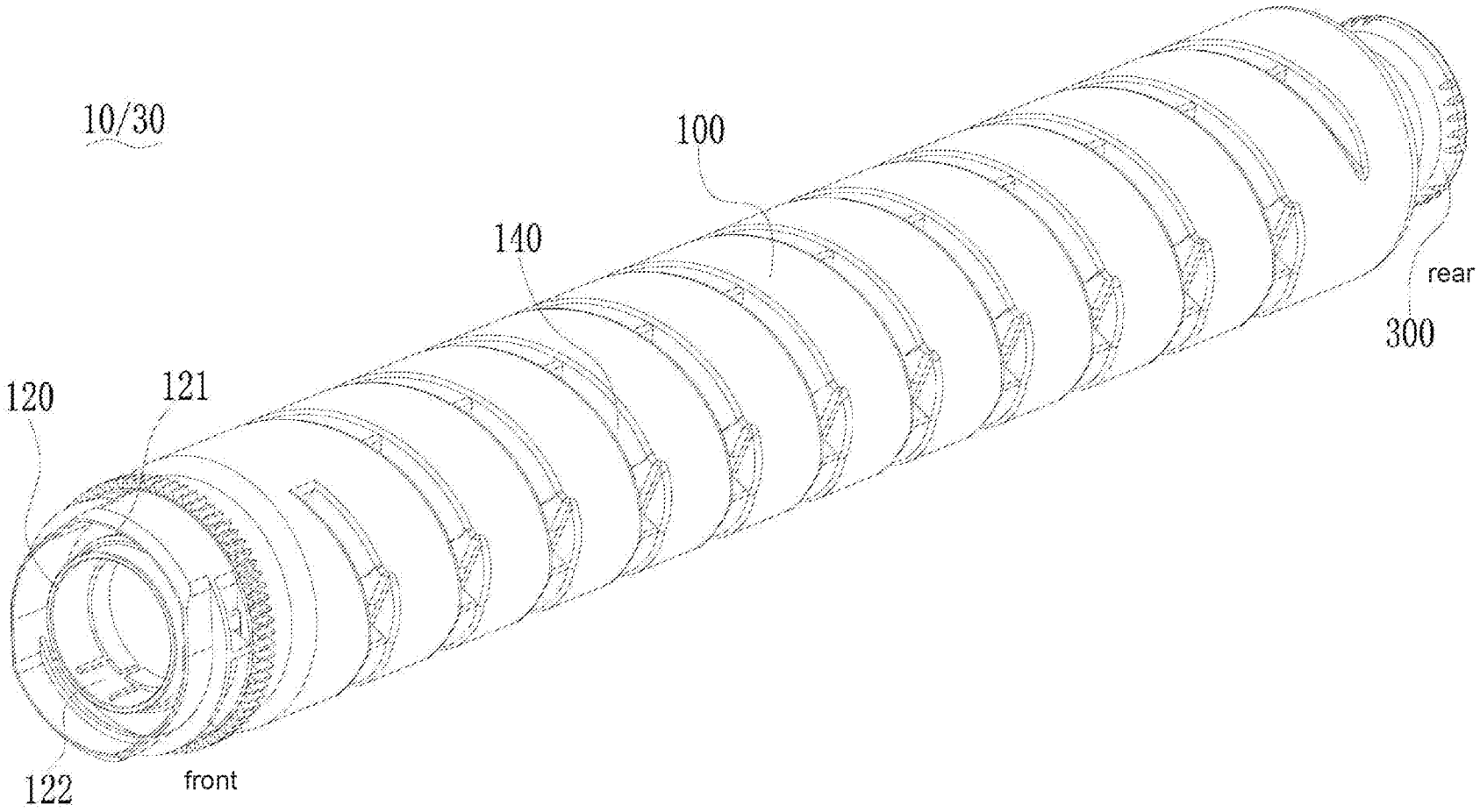
FIG. 2 is a perspective view of a toner bottle and a sensing ring in FIG. 1.
Figure 3:
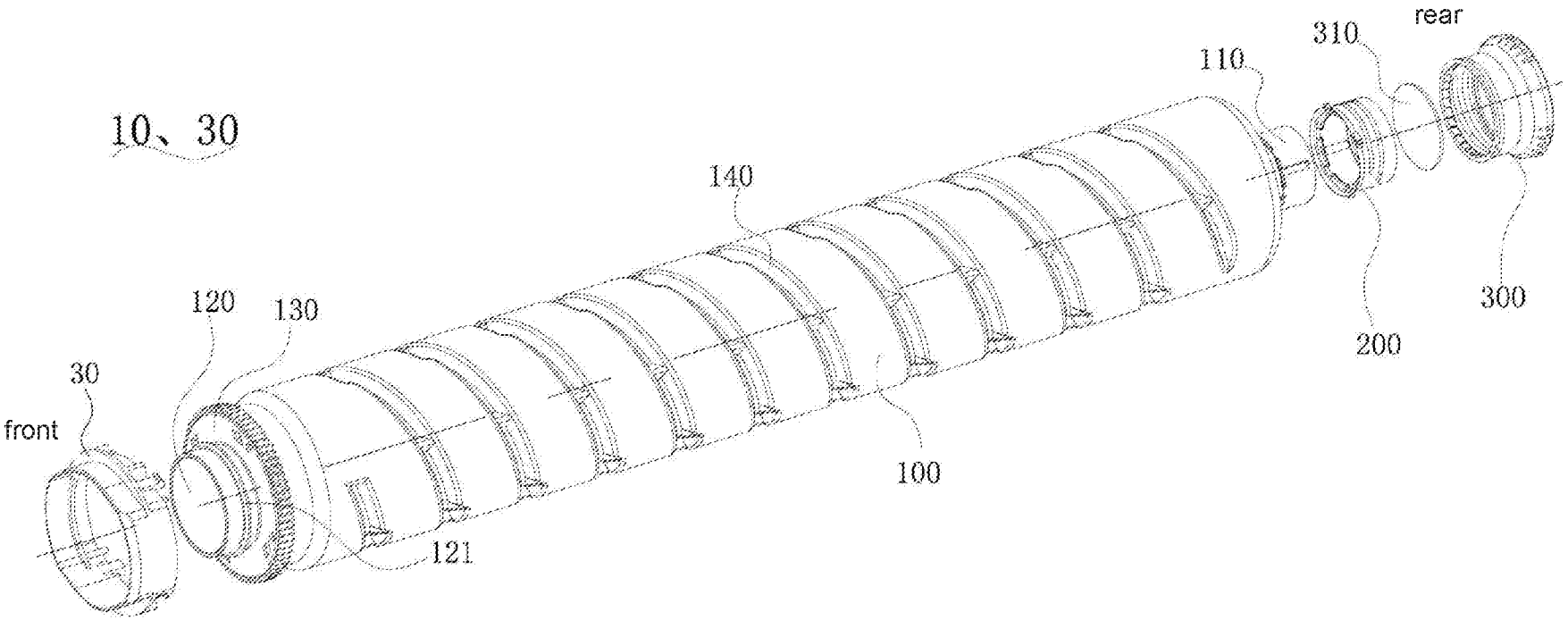
FIG. 3 is an exploded view of FIG. 2.

Toner Bottle:

Referring to FIGS. 2 and 3, the toner bottle 10 comprises a toner bottle main body 100, an anti-retraction ring 200, and a bottle bottom cover 300.

The toner bottle main body 100 is cylinder-like, and a toner adding tube 110 is formed at a rear end of the toner bottle main body 100. The anti-retraction ring 200 is fastened on the toner adding tube 110, and the anti-retraction ring 200 has an external thread. The bottle bottom cover 300 is threadedly connected to the anti-retraction ring 200 for opening or sealing a toner inlet of the toner adding tube 110. A bottle bottom sealing gasket 310 is arranged in the bottle bottom cover 300 for improve sealing of the bottle bottom cover 300.

A toner outlet tube 120 with a reduced internal diameter is formed at a front is end of the toner bottle main body 100. A main gear 130 is fixed on a rear side of the toner outlet tube 120. The printing device drives the toner bottle 100 to rotate through the main gear 130. An annular rib 121 protrudes and is formed on an external circumference of the toner outlet tube 120. A positioning groove 122 is provided at an internal circumference of the toner outlet tube 120. The annular rib 121 and the positioning groove 122 are used to connect the toner outlet structure 20.

A spiral groove 140 is formed on a circumference surface of the toner bottle main body 100, and corresponding spiral groove is also formed on an internal circumference of the toner bottle body 100 to enable the toner to move forward along a spiral direction of the spiral groove when the toner bottle body 100 rotates, and then move to the toner outlet structure 20 through the toner outlet pipe 120.

Because the toner bottle 100 is filled at a bottle tail, the toner cartridge can be used repeatedly, which is more energy-saving and eco-friendly.

Figure 4:
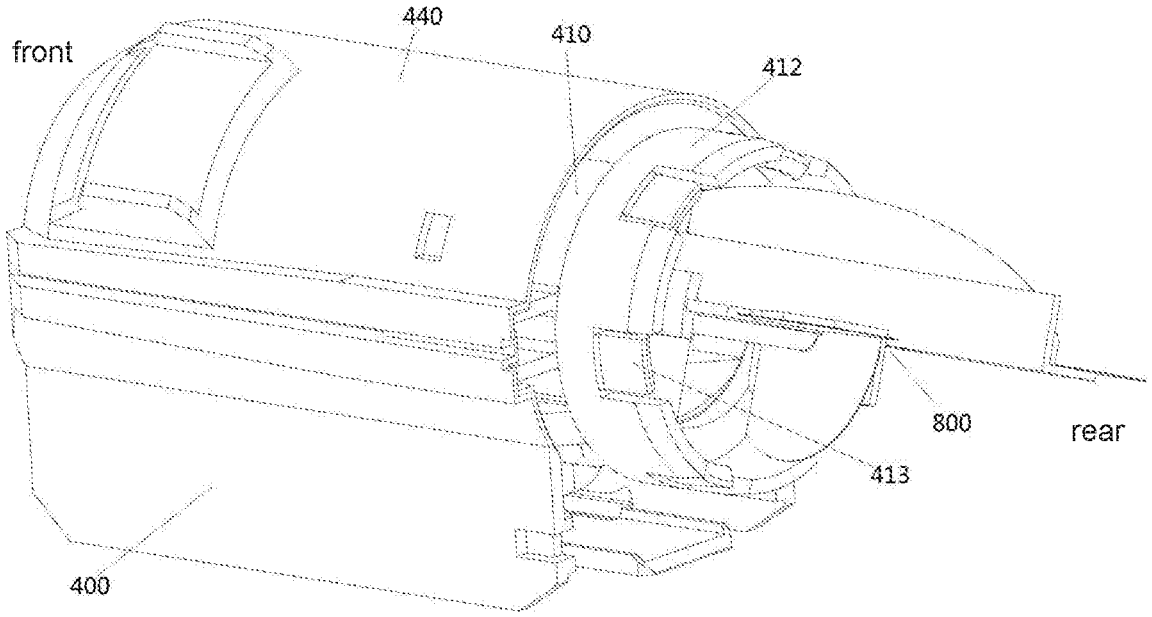
FIG. 4 is a perspective view of a toner output structure in FIG. 1.
Figure 5:
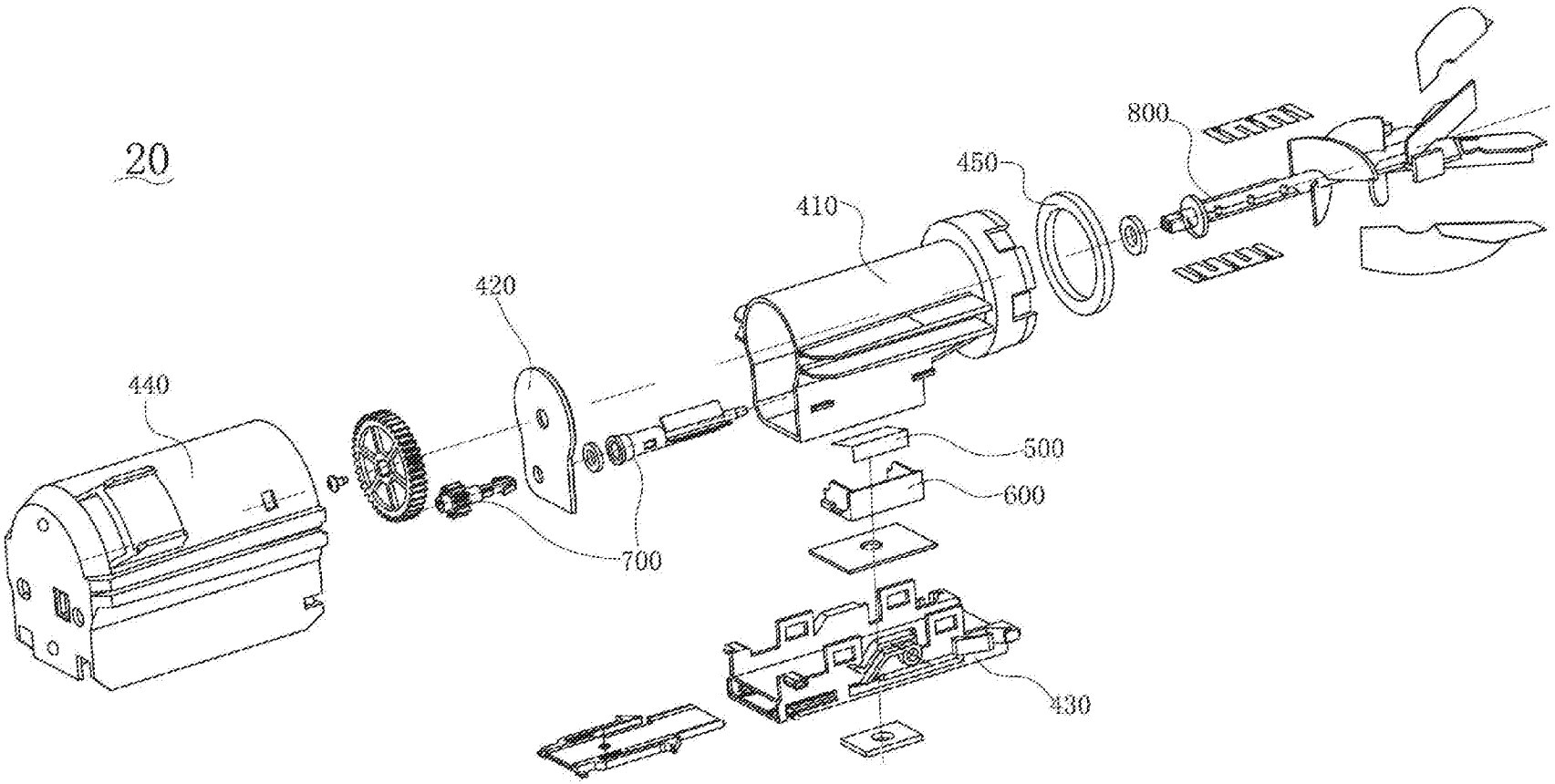
FIG. 5 is an exploded view of FIG. 4.

Toner Outlet Structure:

Referring to FIGS. 4 and 5, the toner outlet structure 20 comprises an outlet front cover 400, a toner outlet elastic sheet 500, a toner receiving box 600, a toner lever 700, and a toner stirring rack 800.

Figure 6:
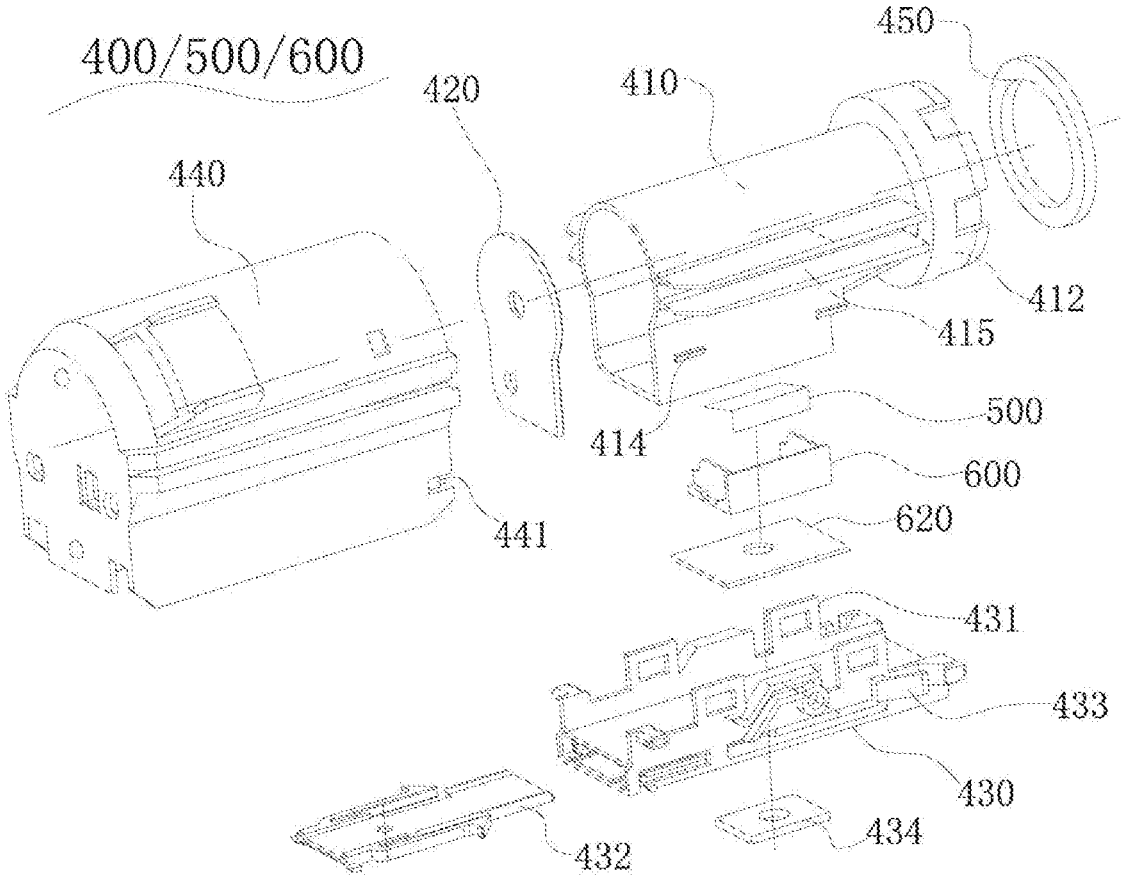
FIG. 6 is an exploded view of an outlet front cover, a toner outlet elastic sheet and a toner receiving box in FIG. 5.
Figure 7:
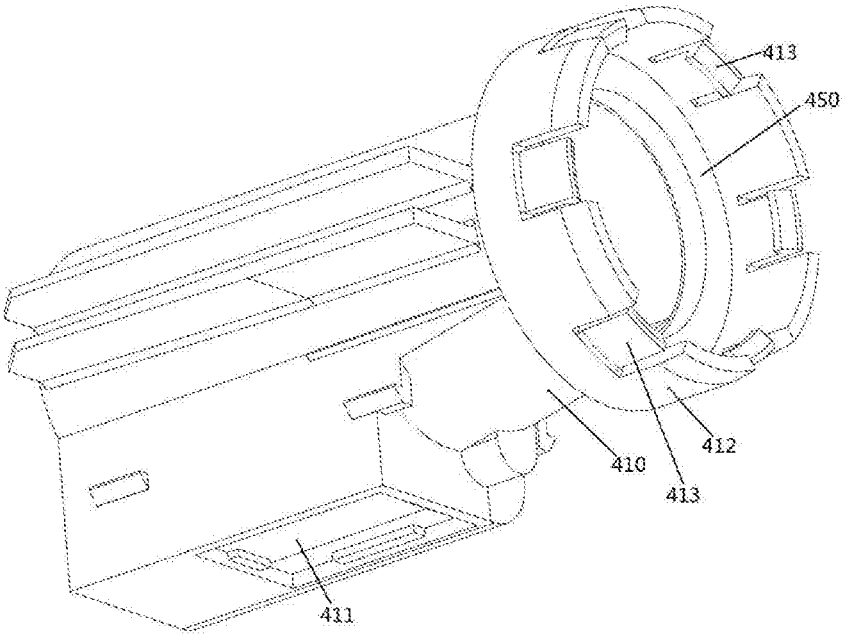
FIG. 7 is a perspective view of an internal cover of the outlet front cover in FIG. 5.

Referring to FIGS. 6 and 7, the outlet front cover 400 comprises an internal cover 410, an internal front cover 420, a toner outlet holder 430, an external cover 440, and a toner bottle front sealing ring 450. The internal cover 410 is equivalent to a toner outlet bin, wherein the toner lever 700, the toner outlet elastic sheet 500, the toner receiving box 600, and the toner stirring rack 800 are all arranged in the internal cover 410. The internal front cover 420 is arranged at a front end of the internal cover 410 to facilitate installation of components such as the toner lever 700 in the internal cover 410. The external cover 440 is sleeved outside the internal cover 410 for connecting and fixing to the printing device. The toner outlet holder 430 is provided at a bottom of the internal cover 410 for opening or closing toner ejection of the internal cover 410. A rear side of the internal cover 410 is provided with the toner bottle front sealing ring 450, to ensure connection with the toner bottle 10 is sealed.

A cavity is formed in the internal cover 410, which communicates with the toner bottle 10. A square toner outlet 411 is provided at the bottom of the internal cover 410 for installing the toner receiving box 600. A toner bottle connecting part 412 is formed at a rear side of the internal cover 410, which is cylindrical. A plurality of elastic hooks 413 is provided on a rear side of the toner bottle connecting part 412 with equal intervals around an axis of the toner bottle connecting part 412. Each of the elastic hooks 413 is clamped to the annular rib 121 of the toner bottle main body 100 for axial positioning when the toner bottle main body 100 rotates relative to the internal cover 410. The toner bottle front sealing ring 450 is embedded in the toner bottle connecting portion 412.

Figure 8:
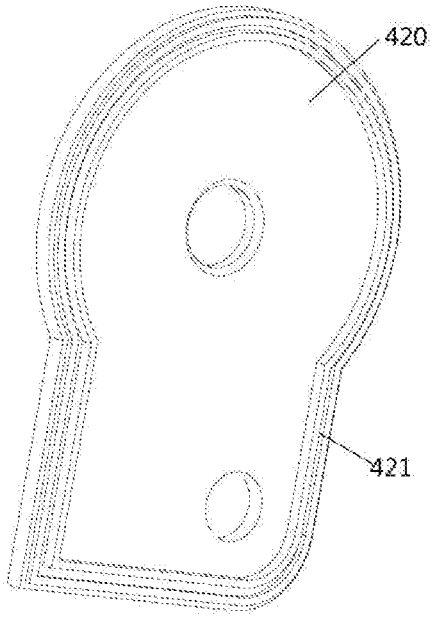
FIG. 8 is a perspective view of an internal front cover of the outlet front cover in FIG. 5.

A lower portion of the internal cover 410 is U-type square groove-shaped, and an upper portion of the internal cover 410 is ¾-round tube-shaped. Referring to FIG. 8, a shape of the internal front cover 420 is adapted to a shape of a front opening of the internal cover 410. A welding rib 421 cooperating with a front end surface of the internal cover 410 is provided on an edge of the internal front cover 420, which is ultrasonically welded to the internal cover 410.

Since the rear end of the internal cover 410 is connected to the toner bottle 10, the internal cover 410 has the front opening, wherein main toner outlet components such as the toner outlet elastic sheet 500, the toner receiving box 600, and the toner lever 700 are installed through the front opening. Therefore, installation and operation are convenient. After installation, the internal front cover 420 and the internal cover 410 are integrally welded, which fully seals the toner in the internal cover 410.

Referring to FIG. 6, the toner outlet holder 430 has two opposing toner outlet holder bayonets 431 at two sides along a front-rear direction, and internal cover fixing blocks 414 corresponding to the toner outlet holder bayonets 431 are provided at a bottom portion of the internal cover 410, in such a manner that the toner outlet holder 430 and the internal cover 410 are clamped and fixed. The toner outlet holder 430 has a toner outlet holder through hole (not shown). A toner outlet sliding plate 432 is provided in the toner outlet holder 430, which can slide back and forth relative to the toner outlet holder 430, for opening or closing the toner outlet holder through hole.

Figure 9:
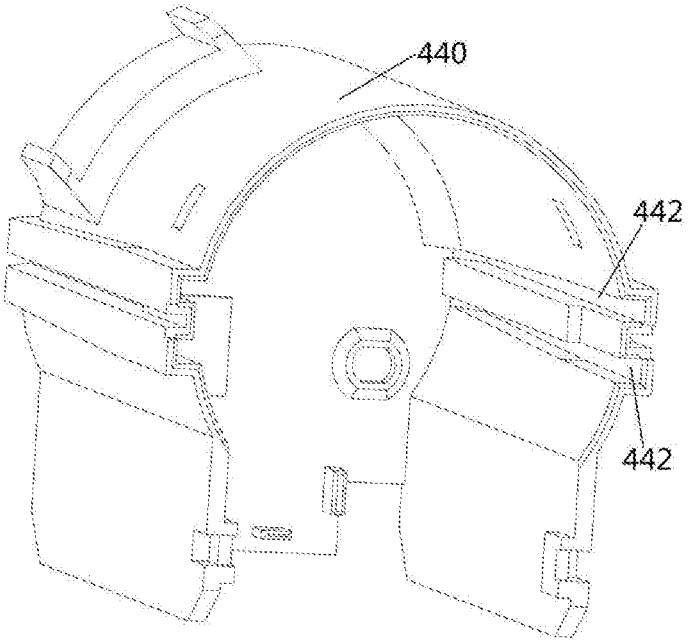
FIG. 9 is a perspective view of an external cover of the outlet front cover in FIG. 5.

Referring to FIG. 9, two elastic buckles 433 are also provided on a rear side of the toner outlet holder 430. Two rear cover fixing blocks 441 are provided at a bottom of a rear side of the external cover 440. The rear cover fixing blocks 441 are clamped with the elastic buckles 433 to fix the external cover 440 with the toner outlet holder 430, that is, with the internal cover 410. The external cover 440 is has a guide groove 442 extending from front to rear, and the internal cover 410 has a guide plate 415 that cooperates with the guide groove 442. The external cover 440 has a rear opening. All parts of the internal cover 410 are arranged in the external cover 440 except the toner bottle connecting part 412.

Figure 11:
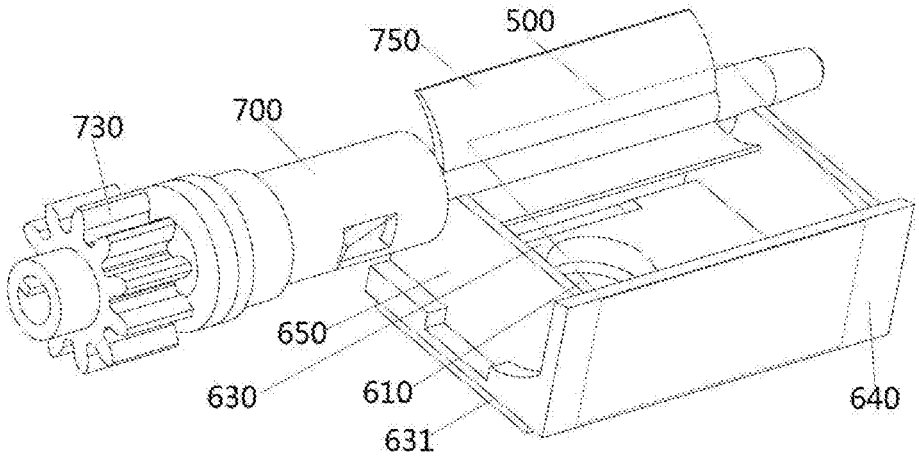
FIG. 11 is a perspective view of an installation structure of the toner lever and the toner receiving box in FIG. 5.

Referring to FIG. 11, the bottom of the toner receiving box 600 is embedded at the toner outlet 411, and the toner receiving box 600 has a toner ejector 610. A toner receiving box sealing gasket 620 is provided at the bottom of the toner receiving box 600 to ensure connection between the internal cover 410 and the toner receiving box 600 is sealed, thereby ensuring that the toner in the internal cover 410 is only ejected from the toner ejector 610. A toner outlet holder sealing gasket 434 is provided between the toner receiving box sealing gasket 620 and the toner outlet holder 430, which has a first sealing gasket hole. The toner receiving box sealing gasket 620 has a second sealing gasket hole. The toner outlet holder 430 has a toner outlet holder through hole, and the toner outlet sliding plate 432 has a sliding plate through hole. The toner ejector 610, the second sealing gasket hole, and the first sealing gasket hole communicate with the toner outlet holder through hole and the sliding plate through hole in sequence.

The outlet front cover 400 adopts guide groove positioning and multiple buckles, which is convenient for processing and installation, saves man-hours, and provides a reliable structure.

Referring to FIGS. 10-15, in the toner outlet structure 20, the toner outlet elastic sheet 500, the toner receiving box 600, and the toner lever 700 are arranged in a square space below the internal cover 410. A front part of the toner stirring rack 800 is arranged in a top space of the internal cover 410.

The toner stirring rack 800 comprises: a toner stirrer 810, a toner collecting sheet 820, a spiral sheet 830, and a toner stirring brush 840. The toner stirrer 810 is in a straight line with an axis of the toner bottle 100. An outermost circumference of the toner stirring rack 800 is provided with a toner stirring rack positioning sheet 850 which is inserted into the positioning groove 122 of the toner bottle 100. A front side of the toner stirrer 810 has a waist-shaped connecting portion 861, a cylindrical portion 862, and a limiting round boss 860 in sequence along an axial direction. The cylindrical portion 862 is rotatably inserted into the internal front cover 420. The limiting round boss 860 protrudes and is formed on a rear side of the cylindrical portion 862, and a toner stirring rack sealing ring 870 is provided between the limiting round boss 860 and the internal front cover 420, in such a manner that a front end of the toner stirring rack 800 is rotatably installed on the internal front cover 420, and is limited with the limiting round boss 860 and the toner stirring rack sealing ring 870. As a result, the toner stirring rack 800 is connected to the internal cover 410 and the toner bottle 100, the toner stirring frame 800 is fixed to the toner bottle 100. When the toner bottle 100 rotates, the toner stirring rack 800 is driven to rotate relative to the internal cover 410.

The toner collecting sheet 820 is arranged at a rear portion of the toner stirrer 810 and the toner stirring rack positioning sheet 850, which is located on the front side of the toner bottle 100 for receiving the toner from the toner bottle 100. The spiral sheet 830 is arranged adjacent to the toner collecting sheet 820, and the spiral sheets 830 are formed by spirally extending around a circumference of the toner stirrer 810 in a front-rear direction. There are two spiral sheets 830, and a toner channel 880 is formed therebetween to guide the toner to a middle of the internal cover 410. The toner stirring brush 840 is installed on a front side of the spiral sheet 830 for stirring the toner in the internal cover 410.

The toner lever 700 is arranged parallel to a front portion of the toner stirrer 810, and a driving gear 890 is fixed on the front end of the toner stirrer 810 by a screw. Specifically, a center hole of the driving gear 890 is waist-shaped, and a cross section of the waist-shaped connecting portion 861 at the front end of the toner stirrer 810 is correspondingly waist-shaped, so as to fix the driving gear 890 on the waist-shaped connecting portion 861. The toner lever 700 comprises a first rod body 710 and a second rod body 720. A V-shaped hook is provided on a rear end of the first rod body 710, and a front end of the second rod body 720 has a blind hole adapted to the V-shaped hook and a connection bayonet located in the blind hole. A driven gear 730 is integrally formed at the front end of the first rod body 710. The rear end of the first rod body 710 passes through the internal cover front cover 420 and is integrally connected to the second rod body 720. A toner lever sealing ring 740 is installed between the first rod body 710 and the internal front cover 420. The driven gear 730 is engaged with the driving gear 890, and a transmission ratio of the driving gear 890 to the driven gear 730 is 1:N (N is greater than 1). Thus, when the toner stirring rack 800 rotates, the toner lever 700 is driven, wherein after one revolution of the toner stirring rack 800 rotates, the toner lever 700 rotates N revolutions.

Specifically, in the embodiment, the transmission ratio of the driving gear 890 to the driven gear 730 is 1:4 or 1:3.

Multiple blades 750 are integrally formed at a rear half of the toner lever 700, which are arranged at equal intervals around an axis of the toner lever 700, in such a manner that a middle arc of a cross section obtained by cutting the blades 750 in a plane perpendicular to the axis of the toner lever 700 is arc-shaped. When the toner lever 700 rotates, the arc-shaped blade 750 can scrape the most toner along its rotation direction. It is understandable that in some other embodiments, the blades 750 may also have other shapes such as a flat plate, which is not limited as long as the toner in the internal cover 410 can be smoothly scraped along the rotation direction.

Specifically, in the embodiment, there are 3-5 blades 750.

The toner outlet elastic sheet 500 is arranged on one side of the toner lever 700 in the internal cover 410, which is made of a PET plastic material with high bending strength and sufficient elasticity. The toner outlet elastic sheet 500 is rectangular with a fixed end 510 at one side, wherein the fixed end 510 is bent and extended to form a bent part 520, and the fixed end 510 can be fixed by fixing the bent part 520. Understandably, in some other embodiments, the toner outlet elastic sheet 500 can also be made of other elastic materials, which is not limited as long as such materials have good elasticity, can quickly rebound after being toggled, and do not adhere to the toner and do not affect movement of the toner. In the cross section obtained by cutting the internal cover 410 in the plane perpendicular to the toner lever 700, the fixed end 510 and a center of the toner lever 700 are on a same horizontal line. When the toner outlet elastic sheet 500 is in a free state, the free end 530 is bent towards the bottom of the toner receiving box 600. When the blades 750 rotate, edges of the blades 750 can contact and press the free end 530 of the toner outlet elastic sheet 500, so as to deform the free end 530.

Figure 10:
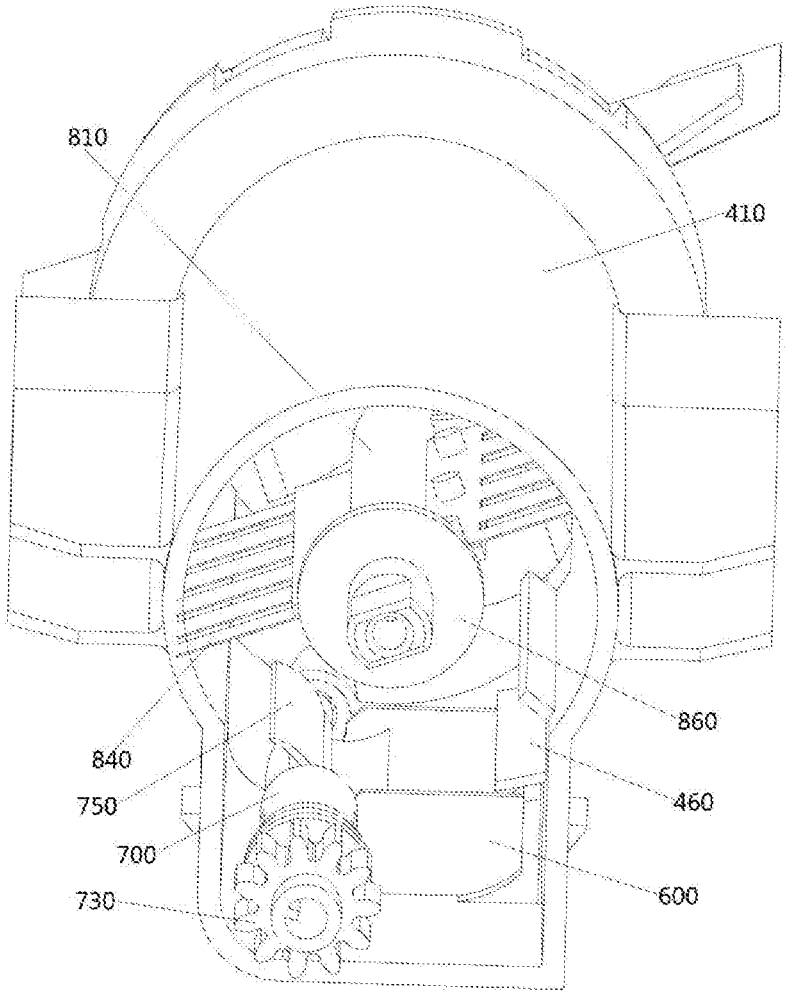
FIG. 10 is a perspective view of an internal structure the internal cover of FIG. 4.
Figure 12A:
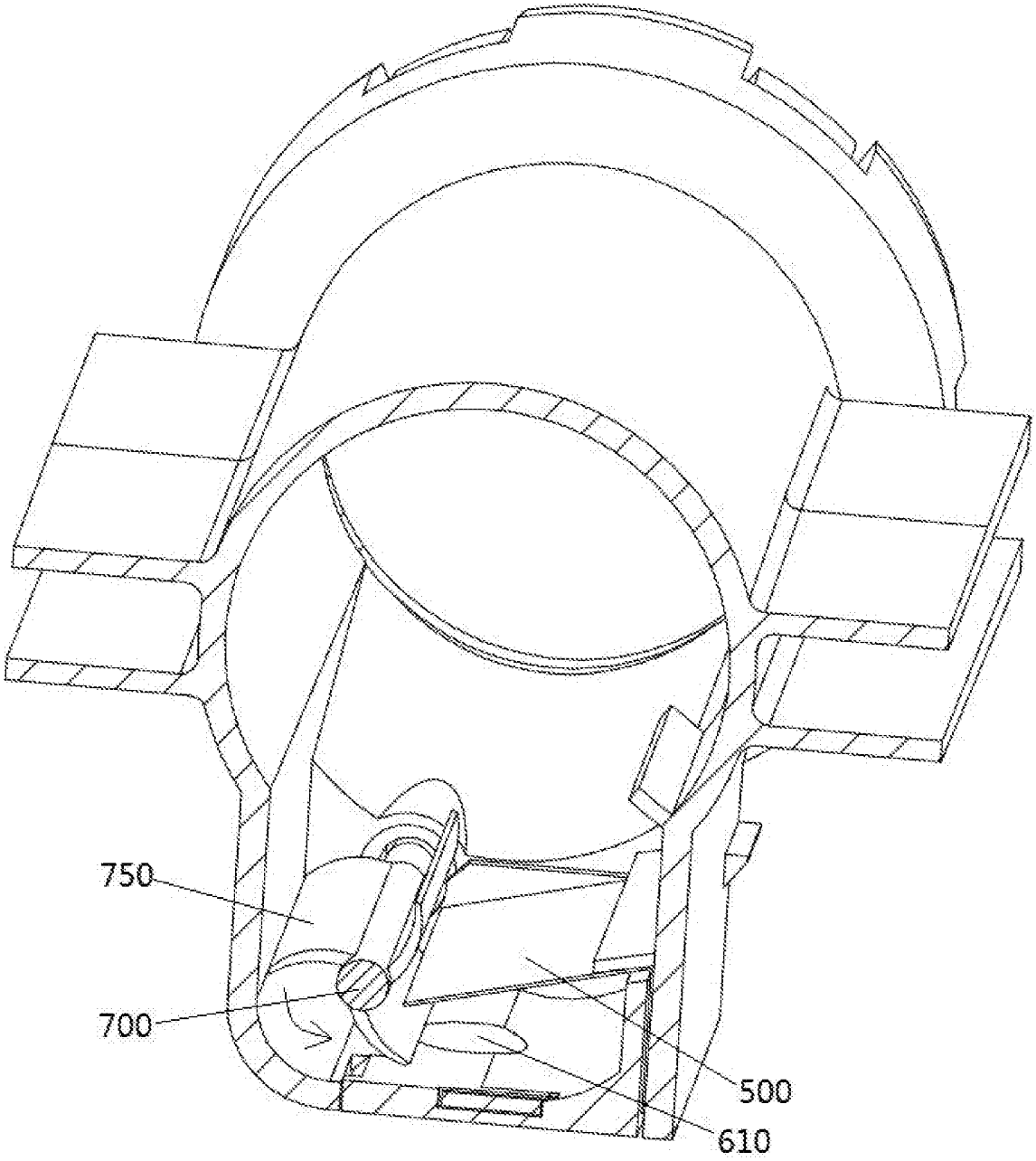
FIG. 12A is a perspective view of the toner outlet elastic sheet in a free state.
Figure 12B:
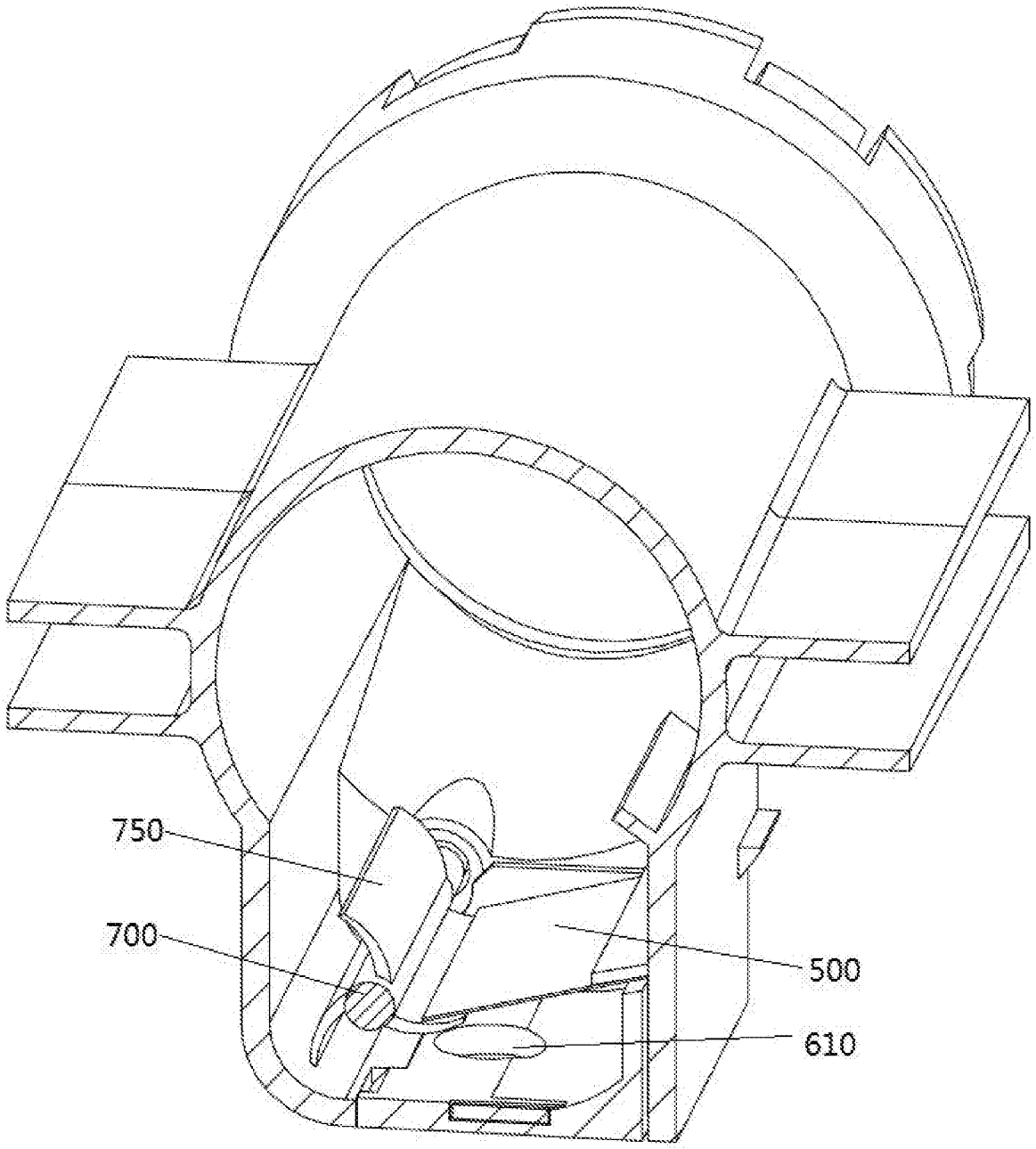
FIG. 12B is a perspective view of the toner outlet elastic sheet just in contact with a blade.
Figure 12C:
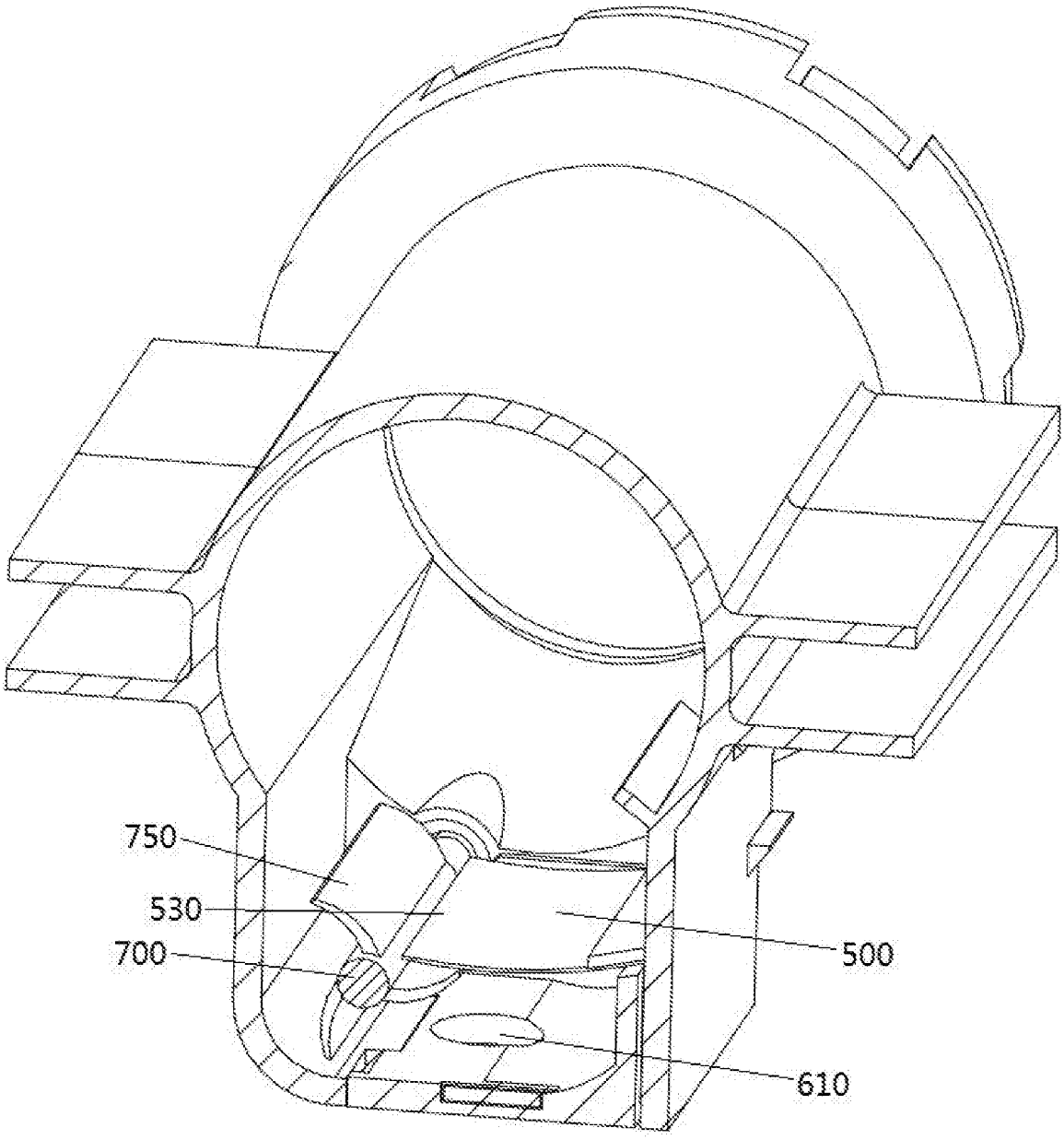
FIG. 12C is a perspective view of the toner outlet elastic sheet squeezed by the blade and elastically deformed.
Figure 12D:
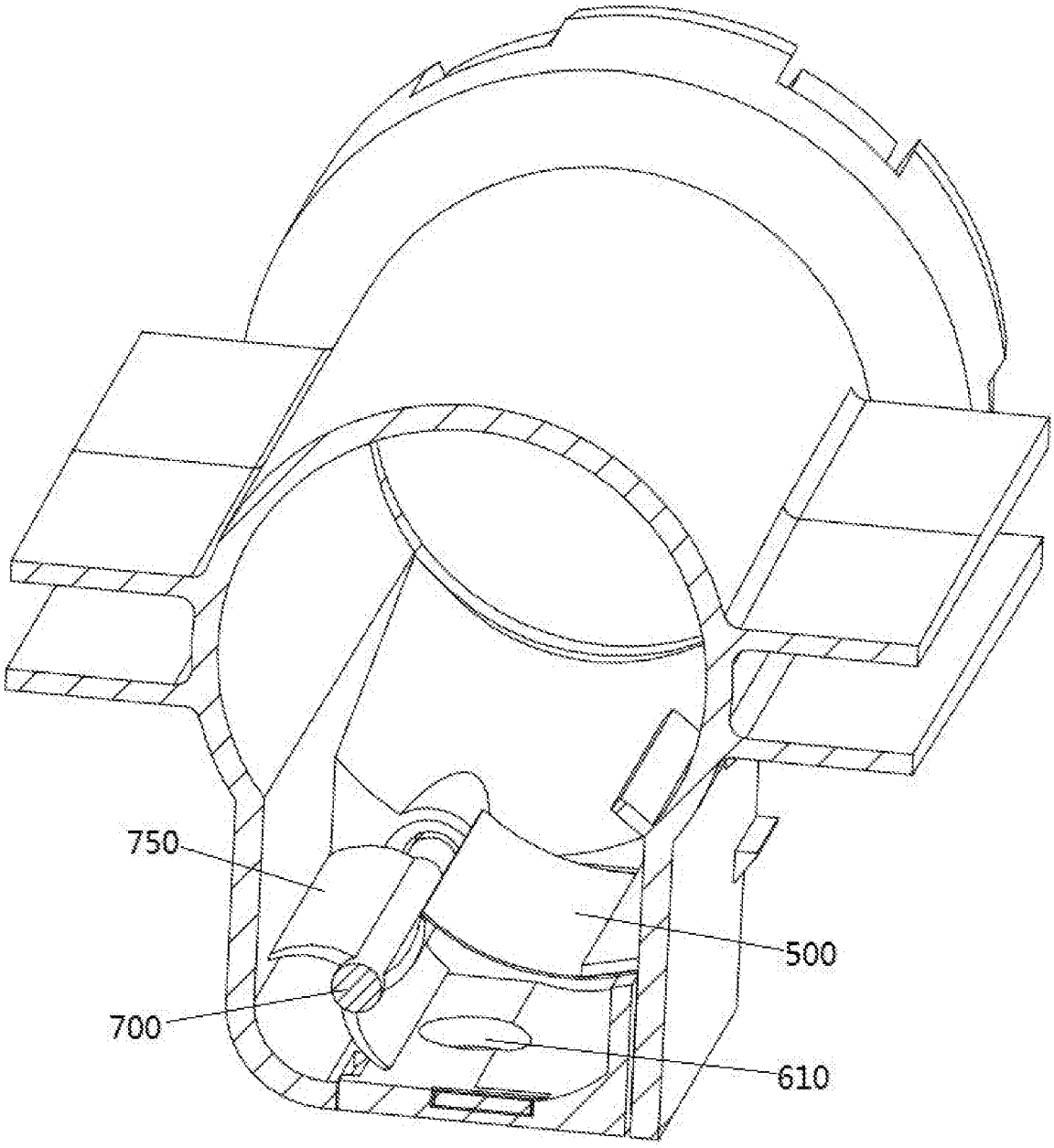
FIG. 12D is a perspective view of the toner outlet elastic sheet about to be separated from the blade.
Figure 13:
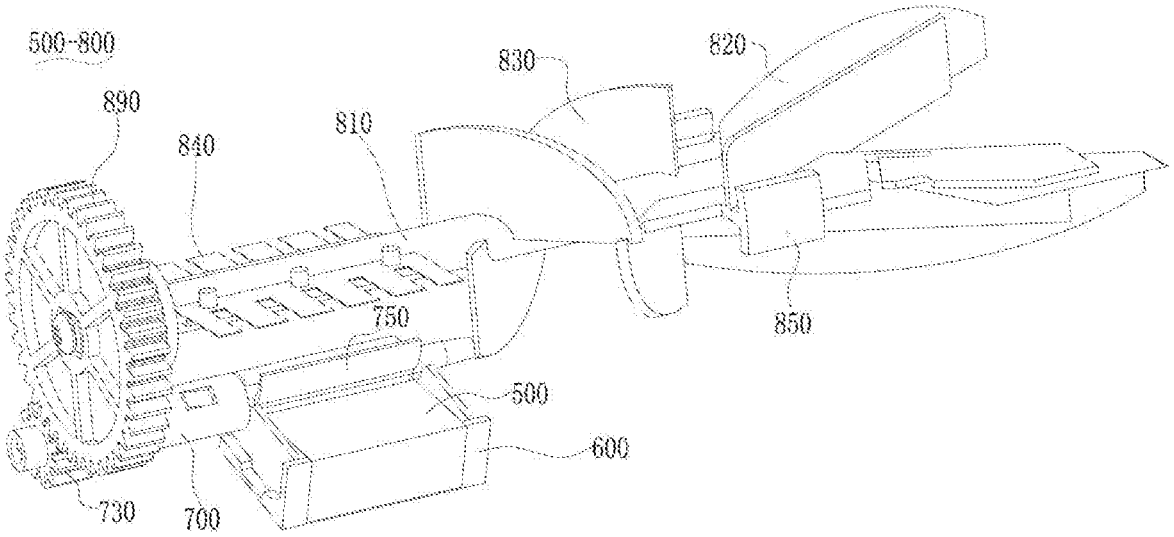
FIG. 13 is a perspective view of an installation structure of a toner stirring rack, the toner lever, the toner receiving box and the toner outlet elastic sheet in the toner cartridge in FIG. 1.
Figure 14:
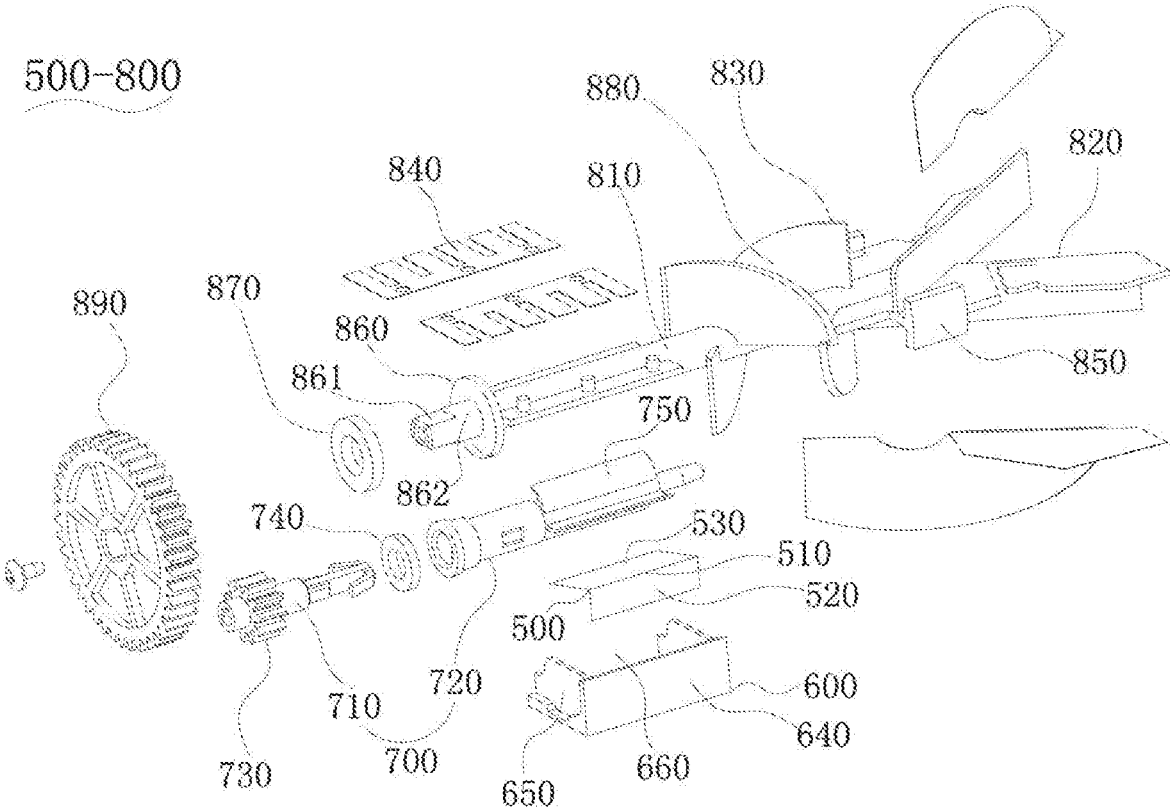
FIG. 14 is an exploded view of FIG. 13.
Figure 15:
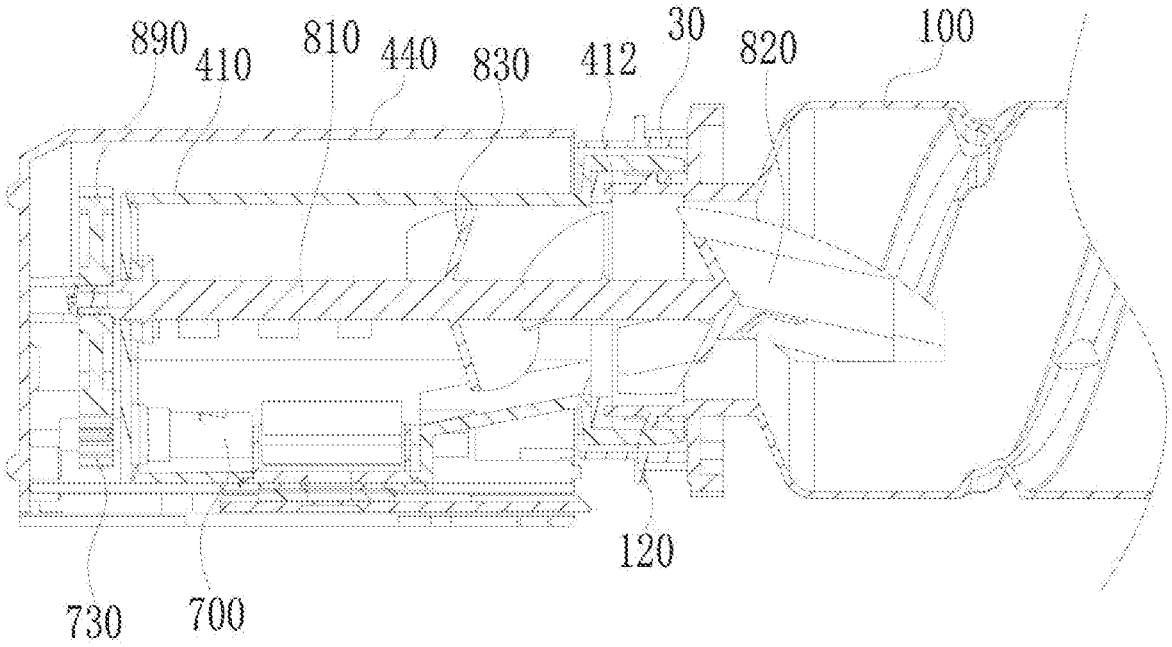
FIG. 15 is a cross-sectional view of FIG. 1.

Referring to FIGS. 10 and 11, the toner outlet elastic sheet 500 in FIG. 11 is transparent. Defining a side on which the bottom of the toner receiving box 600 is located as down, a specific slapping process of the toner outlet elastic sheet 500 is as follows:

S1, as shown in FIG. 12A, when the blades 750 are in a free state and are bent downwards, the blades 750 rotate with the toner lever 700 to scrape the toner counterclockwise to a down side of the toner outlet elastic sheet 500;

S2, as shown in FIG. 12B, as rotating, the blades 750 start to contact a bottom surface of the toner outlet elastic sheet 500 and start to press against the toner outlet elastic sheet 500;

S3, as shown in FIG. 12C, the blades 750 continue to rotate, and squeezes the toner outlet elastic sheet 500, causing the free end 530 of the toner outlet elastic sheet 500 to bend upwards; and as the toner outlet elastic sheet 500 is bent upwards, external arc surfaces of the blades 750 are in contact with the toner outlet elastic sheet 500, and continue to deform the toner outlet elastic sheet 500 until the blades 750 reach an outermost end of the toner outlet elastic sheet 500 as shown in FIG. 12D;

S4: the blades 750 rotate to separate from the toner outlet elastic sheet 500, and the toner outlet elastic sheet 500 rebounds with an elastic force thereof, thereby slapping out the toner scraped by the blades 750 from the toner ejector 610; and S5, as the toner lever 700 continues to rotate, a next blade 750 begins to press against the toner outlet elastic sheet 500, causing the toner outlet elastic sheet 500 to generate next deformation and immediately perform next toner slapping.

In this way, after one revolution of the toner lever 700, toner slapping times of the toner outlet elastic sheet 500 equals to the number of blades. Understandably, in some other embodiments, a position of the toner outlet elastic sheet 500 relative to the toner lever 700 can be slightly changed up, down, left, or right, as long as the toner outlet elastic sheet 500 can contact the blades 750 within a certain distance when the toner lever 700 rotates, thereby ensuring the elastic force generated by the toner outlet elastic sheet 500 is sufficient to slap the toner out of the internal cover 410.

Preferably, in order to enable that the toner sent into the internal cover 410 is scraped intensively to one side of the toner outlet elastic sheet 500 for being slapped, the toner receiving box 600 is provided at one side of the toner outlet elastic sheet 500 facing the toner outlet 411 of the internal cover 410. Referring to FIG. 11, the toner receiving box 600 is enclosed by a square bottom plate 630, a back plate 640 perpendicular to the bottom plate 630, and two side plates 650. The bottom plate 630 is embedded at the toner outlet 411 through a bottom convex portion 631, and the toner ejector 610 is provided in a middle of the bottom plate 630. A side opening 660 between the two side plates 650 faces the blades 750. The bent portion 520 of the toner outlet elastic sheet 500 is glued to the back plate 640. In addition, a baffle 460 is provided in the internal cover 410 to make the toner outlet elastic sheet 500 bend downwards when in a free state. In this way, the blades 750 can well scrape the toner into the toner receiving box 600 through the side opening 660. After the toner outlet elastic sheet 500 rebounds, the toner is concentrated in the toner receiving box 600 and is slapped in a reverse direction. The toner will not disperse in the front-rear direction due to enclosure of the side plates 650, but will be ejected out by the toner ejector 610.

Therefore, when the printing device drives the toner bottle main body 100 to rotate, the toner stirring rack 800 rotates accordingly, and transfers the toner in the toner bottle main body 100 to the internal cover 410; the driving gear 890 at the end of the toner stirring rack 800 is engaged with the driven gear 730 to rotate the toner lever 700, so that the blades 750 rotate; the blades 750 scrape the toner into the toner receiving box 600 as well as press the toner outlet elastic sheet 500; when the blade 750 rotates to separate from the toner outlet elastic sheet 500 the toner outlet elastic sheet 500 rebounds under its elastic force and slaps the toner out of the toner receiving box 600. Due to the toner lever 700 and the toner outlet elastic sheet 500, after one revolution of the toner bottle main body 100, the number of times the toner outlet elastic sheet 500 slaps the toner equals to the transmission ratio N of the driving gear 890 to the driven gear 730 multiplied by the number of the blades 750. Therefore, the toner is ejected multiple times within one revolution of the toner cartridge, thereby improving the toner outlet speed thereof.

In addition, increase of the toner outlet speed also increases a toner outlet temperature and smoothens toner ejection. The toner stirring brush 840 of the toner stirring rack 800 is capable of stirring and dispersing the toner in the internal cover 410, which further prevents accumulation of toner in the toner outlet structure 20.

The above descriptions are only the preferred embodiments of the present invention, and do not limit the scope of the present invention. Any equivalent structural transformations using the contents of the description and drawings of the present invention, or direct/indirect application in other related technical fields under the inventive concept of the present invention, are within the protection scope of the present invention.

What is claimed is:

1. A toner outlet structure, comprising: an outlet front cover communicating with a toner bottle containing toner, wherein the outlet front cover has a toner outlet;

a toner lever rotatably arranged in the outlet front cover, wherein a plurality of blades are provided on the toner lever;

a toner outlet elastic sheet having a fixed end and a free end opposite to the fixed end, wherein the fixed end is fixed in the outlet front cover; the toner outlet elastic sheet extends in a circumferential direction of the toner lever, and extends into a circular track formed by rotation of the blades; and a toner stirring rack, wherein a driving gear is fixed at a front end of the toner stirring rack;

wherein the blades rotate together with the toner lever to scrape the toner sent from the toner bottle to one side of the toner outlet elastic sheet; as the blades rotate, the blades contact and press the toner outlet elastic sheet, in such a manner that the free end of the toner outlet elastic sheet is deformed along a centrifugal direction of edges of the blades; when the blades rotate to separate from the toner outlet elastic sheet, the free end of the toner outlet elastic sheet rebounds with an elastic force thereof, thereby slapping out the toner from the toner outlet;

wherein a driven gear is fixed to a front end of the toner lever having the blades, and the driving gear is engaged with the driven gear; a transmission ratio of the driving gear to the driven gear is 1:N, and N>1.

2. The toner outlet structure, as recited in claim 1, wherein the toner stirring rack comprises:

a toner stirrer, wherein the toner stirrer is parallel to the toner lever and is installed in the outlet front cover; and a toner stirring brush arranged at one end of the toner stirrer in the outlet front cover, and is parallel to the blades for stirring the toner in the outlet front cover.

3. The toner outlet structure, as recited in claim 2, wherein the toner stirring rack further comprises:

a toner collecting sheet arranged on the other end of the toner stirrer away from the toner stirring brush, to receive the toner from the toner bottle; and multiple spiral sheets arranged between the toner collecting sheet on the toner stirrer and the toner stirring brush, wherein the spiral sheet spirally extends around the toner stirrer, and a toner channel is formed between adjacent spiral sheets.

4. The toner outlet structure, as recited in claim 1, wherein the toner lever comprises:

a first rod body, wherein a V-shaped hook is provided on a rear side of the first rod body; and a second rod body, wherein a connector cooperating with the V-shaped hook is formed at a front side of the second rod body; the blades are provided on the second rod body;

wherein the driven gear is integrally formed at a front end of the first rod body; the first rod body passes through a front end of the outlet front cover and is engaged with the second rod body.

5. The toner outlet structure, as recited in claim 4, wherein a front side of the toner stirring rack has a waist-shaped connecting portion, a cylindrical portion, and a limiting round boss in sequence along an axial direction; the cylindrical portion passes through the front end of the outlet front cover and is rotatable; the waist-shaped connecting portion is arranged at a front side of the cylindrical portion, and penetrates out of the outlet front cover; the driving gear is fixed to the waist-shaped connecting portion; the limiting round boss protrudes on a rear side of the cylindrical portion; and a toner stirring rack sealing ring is arranged between the limiting round boss and the outlet front cover.

6. The toner outlet structure, as recited in claim 1, wherein a front side of the toner stirring rack has a waist-shaped connecting portion, a cylindrical portion, and a limiting round boss in sequence along an axial direction; the cylindrical portion passes through the front end of the outlet front cover and is rotatable; the waist-shaped connecting portion is arranged at a front side of the cylindrical portion, and penetrates out of the outlet front cover; the driving gear is fixed to the waist-shaped connecting portion; the limiting round boss protrudes on a rear side of the cylindrical portion; and a toner stirring rack sealing ring is arranged between the limiting round boss and the outlet front cover.

7. A toner cartridge, comprising:

a toner bottle containing toner; and a toner outlet structure, wherein the toner bottle is rotatably connected to a rear end of an outlet front cover;

wherein the outlet front cover comprises:

an internal cover, wherein a toner outlet is provided at a bottom of the internal cover; and a toner bottle connecting part is provided at a rear end of the internal cover, which is rotatably connected to the toner bottle;

an internal front cover fixed to a front end of the internal cover; and a toner outlet holder installed at a bottom of the internal cover for opening or closing the toner outlet;

wherein the toner outlet holder has two opposing toner outlet holder bayonets at two sides along a front-rear direction; two internal cover fixing blocks corresponding to the toner outlet holder bayonets are provided at two sides of the internal cover along the front-rear direction, which are used to clamp and fix the toner outlet holder and the internal cover;

the outlet front cover further comprises:

an external cover, wherein two rear cover fixing blocks are provided at a rear side of the external cover; two elastic buckles cooperating with the rear cover fixing blocks are provided at two sides of the toner outlet holder along the front-rear direction, which are used to fix the external cover and the toner outlet holder;

wherein the external cover is also provided with a guide groove extending from front to rear; the internal cover is provided with a guide plate cooperating with the guide groove; all parts of the internal cover are arranged in the external cover except the toner bottle connecting part.

8. The toner cartridge, as recited in claim 7, wherein a bottom of a toner receiving box is embedded at the toner outlet of the internal cover, and a toner receiving box sealing gasket is provided at the toner outlet; the toner receiving box sealing gasket has a first sealing gasket through hole; the toner outlet holder has a toner outlet holder through hole, and a toner outlet holder sealing gasket is provided at the toner outlet holder through hole; the toner outlet holder sealing gasket has a second gasket through hole; a toner ejector of the toner receiving box is connected to the first sealing gasket through hole, the second sealing gasket through hole, and the toner outlet holder through hole in sequence;

a toner outlet sliding plate is provided in the toner outlet holder, which moves back and forth relative to the toner outlet holder; the toner outlet sliding plate has a sliding plate through hole; when the sliding plate through hole corresponds to the toner outlet holder through hole, the toner is slapped out through the sliding plate through hole.

9. The toner cartridge, as recited in claim 7, wherein the toner bottle comprises:

a toner bottle main body, wherein a spiral groove is formed on a circumference surface of the toner bottle main body;

a toner adding tube formed at a rear end of the toner bottle main body, wherein an anti-retraction ring is fastened on the toner adding tube, and the anti-retraction ring has an external thread;

a bottle bottom cover threadedly connected to the toner adding tube for sealing the toner adding tube;

a bottle bottom sealing gasket arranged in the bottle bottom cover; and a toner outlet tube formed at a front end of the toner bottle main body.

10. The toner cartridge, as recited in claim 9, wherein a main gear is fixed on a side of the toner outlet tube near the toner bottle main body for driving the toner bottle main body to rotate.

11. The toner cartridge, as recited in claim 9, wherein an annular rib protrudes and is formed on an external circumference of the toner outlet tube; the toner bottle connecting part is provided at the rear end of the internal cover, and the toner bottle connecting part is cylindrical; a toner bottle front sealing ring is provided at an internal end of the toner bottle connecting part; a plurality of elastic hooks are arranged on a rear side of the toner bottle connecting part, and the elastic hooks are hung on the annular rib, in such a manner that the toner bottle connecting part is rotatable relative to the toner bottle.

12. The toner cartridge, as recited in claim 7, wherein a toner stirring rack positioning sheet is provided on an external circumference of a toner stirring rack; a positioning groove is provided at a front side of an internal circumference of the toner bottle; an opening of the positioning groove faces forward; the toner stirring rack positioning sheet is inserted into the positioning groove from front to rear; a limiting boss is provided at a front side of the toner stirring rack along an axial direction thereof; a front end of the toner stirring rack is installed on the internal cover and is limited by the limiting boss.

* * * * *